US009955786B2

(12) United States Patent
Kato

(10) Patent No.: US 9,955,786 B2
(45) Date of Patent: May 1, 2018

(54) LEGGED FURNITURE, AND LEG ADJUSTER AND LEG ADJUSTER SET FOR USE IN SAME

(71) Applicant: Toshiyuki Kato, Saitama (JP)

(72) Inventor: Toshiyuki Kato, Saitama (JP)

(73) Assignee: Shikumi Co., Ltd. (JP)

( * ) Notice: Subject to any disclaimer, the term of this patent is extended or adjusted under 35 U.S.C. 154(b) by 0 days. days.

(21) Appl. No.: 15/503,535

(22) PCT Filed: Nov. 12, 2015

(86) PCT No.: PCT/JP2015/081866
§ 371 (c)(1),
(2) Date: Feb. 13, 2017

(87) PCT Pub. No.: WO2016/088529
PCT Pub. Date: Jun. 9, 2016

(65) Prior Publication Data

US 2017/0258228 A1 Sep. 14, 2017

(30) Foreign Application Priority Data

Dec. 2, 2014 (WO) ..... PCT/JP2014/081851

(51) Int. Cl.
*A47B 91/00* (2006.01)
*A47B 91/02* (2006.01)
*A47B 13/02* (2006.01)

(52) U.S. Cl.
CPC ..... *A47B 91/024* (2013.01); *A47B 13/023* (2013.01); *A47B 2013/025* (2013.01)

(58) Field of Classification Search
CPC ..... A47B 91/024; A47B 13/023; A47B 2013/025
(Continued)

(56) References Cited

U.S. PATENT DOCUMENTS 3,191,895 A 6/1965 Whelan
4,178,858 A * 12/1979 Ponzellini ..... A47B 13/023 108/150
(Continued)

FOREIGN PATENT DOCUMENTS

DE 2630416 A1 5/1977
JP 51-437 Y2 1/1976
(Continued)

OTHER PUBLICATIONS

Korean Office Action for Application No. 10-2016-7029348 dated Mar. 2, 2017.
(Continued)

*Primary Examiner* — Gwendolyn W Baxter
(74) *Attorney, Agent, or Firm* — Tarolli, Sundheim, Covell & Tummino LLP

(57) ABSTRACT

In legged furniture having four or more legs and a load-receiving stage supported directly or indirectly by these legs, this legged furniture includes three main legs defining a triangular shape in a plurality of the legs and, assuming that the legged furniture is placed by using only the main legs, enabling a stable stationary attitude of the load-receiving stage, and a leg adjuster forming an extension portion of a sub leg other than the main legs and capable of expansion/contraction in a vertical direction and providing an expansion/contraction leg in cooperation with the sub leg and autonomously allows expansion or contraction of the expansion/contraction leg on the basis of a length of the main leg in accordance with the stationary attitude of the load-receiving stage.

10 Claims, 17 Drawing Sheets

(58) Field of Classification Search
USPC ..... 248/188.1, 188.2, 188.5, 188.7, 188.9, 248/631
See application file for complete search history.

(56) References Cited

U.S. PATENT DOCUMENTS

| | | | | |
|---|---|---|---|---|
| 5,251,858 | A | 10/1993 | Ultee | |
| 9,144,300 | B2 * | 9/2015 | Cotey | A47B 3/0815 |

FOREIGN PATENT DOCUMENTS

| | | | |
|---|---|---|---|
| JP | 60-13720 | B2 | 4/1985 |
| JP | 63-117331 | U | 7/1988 |
| JP | 08-336436 | A | 12/1996 |
| JP | H08336436 | | 12/1996 |
| JP | 2003-153756 | A | 5/2003 |
| JP | 2008-86609 | A | 4/2008 |
| KR | 20-0141269 | Y1 | 4/1999 |

OTHER PUBLICATIONS

International Search Report for Application No. PCT/JP2015/081866 dated Feb. 2, 2016.
Extended European Search Report for corresponding European Application No. 15864451.8-1653/3167761 dated Oct. 13, 2017.

* cited by examiner

LEGGED FURNITURE, AND LEG ADJUSTER AND LEG ADJUSTER SET FOR USE IN SAME

RELATED APPLICATIONS

The present invention is a U.S. National Stage under 35 USC 371 patent application, claiming priority to Serial No. PCT/JP2015/081866, filed on 12 Nov. 2015; which claims priority from PCT/JP2014/081851, filed 2 Dec. 2014, the entirety of both of which are incorporated herein by reference.

TECHNICAL FIELD

The present invention relates to legged furniture, and a leg adjuster and an adjuster set for use in the same and particularly to legged furniture such as a table having four legs or more, and a leg adjuster and a leg adjuster set for use in the same.

BACKGROUND ART

Patent Document 1 discloses a table including a leg adjuster forming an extension portion of a leg. The leg adjuster has a threaded portion screwed into a lower end portion of the leg and functions as a height adjusting mechanism in which the length of the leg is adjusted by rotating the threaded portion.

PRIOR ART DOCUMENT

Patent Document

Patent Document 1: Japanese Patent Laid-Open No. 2003-153756

SUMMARY OF THE INVENTION

Problems to be Solved by the Invention

A floor surface of a shop such as a restaurant has some inclination or irregularity even in a newly constructed building. A floor surface of, in particular, a long-existing shop such as a tenant building tends to have more inclination or irregularity due to long time use. The aforementioned prior-art table can be installed with its table surface horizontal and without rattling by using a leg adjuster to adjust the length of the leg in accordance with inclination or irregularity of the floor surface.

However, such tables might be collected to one spot for cleaning on the floor after the shop is closed or arrangement of the tables might be changed for refurbishment of the shop in some cases. In such a case, it is difficult to arrange a specific table to the original position on the floor. In particular, in the case of the table having four legs or more, it is difficult to arrange the table without changing a grounding position of each leg with respect to the floor surface from the original. Therefore, a shop clerk needs to readjust the length of the leg by manipulating the leg adjuster of each leg of many tables such that the table surface becomes horizontal and the table does not rattle at every floor cleaning or refurbishment, which forces the shop clerk a heavy work load.

Moreover, if the shop clerk does not adjust the leg adjuster after floor cleaning or refurbishment, it is highly likely that the table rattles. A customer who uses the rattling table might be dissatisfied with the shop environment because a drink might spill from a container such as a cup or a glass on the table surface due to rattling or a work performed on the table is hindered, and the usability of the table is poor.

The present invention has been made in view of such problems and an object thereof is to provide legged furniture, and a small-sized detachable leg adjuster and a leg adjuster set for use in the same which can reduce a work load of length adjustment of the leg and can improve the usability.

Means for Solving the Problems

In order to achieve the aforementioned object, legged furniture of the present invention includes, in legged furniture having four or more legs and a load-receiving stage supported directly or indirectly by these legs, three main legs among the legs defining a triangular shape, the three main legs enabling a stable stationary attitude of the load-receiving stage assuming that the legged furniture is placed by using only the main legs, a leg adjuster forming an extension portion of a sub leg other than the main legs and capable of expansion/contraction in a vertical direction and providing an expansion/contraction leg in cooperation with the sub leg and autonomously allowing expansion or contraction of the expansion/contraction leg on the basis of a length of the main leg in accordance with the stationary attitude of the load-receiving stage.

Moreover, another legged furniture of the present invention includes, in legged furniture having four or more legs and a load-receiving stage supported directly or indirectly by these legs, three main legs among the legs defining a triangular shape, the three main legs enabling a stable stationary attitude of the load-receiving stage assuming that the legged furniture is placed by using only the main legs, a leg adjuster forming an extension portion of a sub leg shorter than the main legs and capable of expansion/contraction in a vertical direction and providing an expansion/contraction leg in cooperation with the sub leg and capable of adjustment of expansion or contraction of the expansion/contraction leg on the basis of a length of the main leg in accordance with the stationary attitude of the load-receiving stage.

Preferably, the leg adjuster includes an adjuster body attached to a lower end of the sub leg and capable of expansion/contraction in a vertical direction, urging means for urging the adjuster body in an expansion direction, and regulating means for regulating an expansion speed of the adjuster body receiving the urging force of the urging means and a contraction speed of the adjuster body against the urging force.

Preferably, the adjuster body is in the form of a hydraulic cylinder, the adjuster body has an outer cylinder being a leg end of the expansion/contraction leg and having an opening hole and a bottom part, a piston accommodated in the outer cylinder, a piston rod protruding from the outer cylinder through the opening hole, and a threaded portion provided at a distal end of the piston rod and screwed into a lower end portion of the sub leg, the urging means has a compression coil spring accommodated in the outer cylinder and extended between a lower part of the piston and a bottom part of the outer cylinder, and the regulating means has two liquid chambers partitioned by the piston in the outer cylinder and a first micro clearance ensured between an inner circumferential surface of the outer cylinder and an outer circumferential surface of the piston in order to regulate flowing of a liquid between these liquid chambers.

Preferably, the adjuster body has rotation preventing means for preventing rotation of the outer cylinder with respect to the piston or the piston rod.

Preferably, the rotation preventing means prevents rotation of the outer cylinder with respect to the piston or the piston rod by forming a non-perfect circular shape when seen from a cross section on at least one of the outer circumferential surface of the piston or the piston rod and an inner circumferential surface of the outer cylinder.

Preferably, the leg adjuster has leakage preventing means for preventing leakage of the liquid from the opening hole.

Preferably, a second micro clearance is ensured between the piston rod and the opening hole, and the leakage preventing means is made of a seal member forming a space on the second micro clearance side in the outer cylinder by partitioning the outer cylinder from the liquid chamber on the piston rod side.

Preferably, the seal member is formed having an annular band shape of an inner end locked by the outer circumferential surface of the piston rod and an outer end locked by the outer cylinder and allows expansion/contraction between the inner end and the outer end.

Preferably, the outer cylinder has a small-diameter portion in which each liquid chamber is formed and a large-diameter portion in which a space is formed.

Preferably, a dummy adjuster forming an extension portion of the main leg and presenting an appearance similar to the adjuster body is further included, and a main-leg raising from a lower surface of a outer cylinder of the dummy adjuster to a lower end portion of the main leg is set between a minimum raising of the sub leg when the leg adjuster is in a most contracted state and a maximum raising of the sub leg when the leg adjuster is in a most expanded state.

Preferably, a gravity center line of the legged furniture passes in a triangular shape or in the vicinity of the triangular shape.

Moreover, the leg adjuster of the present invention is a leg adjuster used for legged furniture having four or more legs and a load-receiving stage supported directly or indirectly by these legs, in which the legged furniture has: three main legs among the legs defining a triangular shape and, assuming that the legged furniture is placed by using only the main legs, enabling a stable stationary attitude of the load-receiving stage; and a sub leg other than the main legs, the leg adjuster is detachably attached to the sub leg in order to form an extension portion of the sub leg and is capable of expansion/contraction in a vertical direction and provides an expansion/contraction leg in cooperation with the sub leg and autonomously allows expansion or contraction of the expansion/contraction leg on the basis of a length of the main leg in accordance with the stationary attitude of the load-receiving stage, and the leg adjuster includes an adjuster body in the form of a hydraulic cylinder, comprising an outer cylinder having an opening hole and a bottom part, a piston accommodated in the outer cylinder, a piston rod protruding from the outer cylinder through the opening hole, and a threaded portion provided at a distal end of the piston rod and screwed into a lower end portion of the sub leg, urging means having a compression coil spring accommodated in the outer cylinder and extended between a lower part of the piston and the bottom part of the outer cylinder, and regulating means having two liquid chambers partitioned by the piston in the outer cylinder and a first micro clearance ensured between an inner circumferential surface of the outer cylinder and an outer circumferential surface of the piston in order to regulate flowing of a liquid between these liquid chambers.

Moreover, the leg adjuster set of the present invention is made of combination of at least one unit of the aforementioned leg adjuster and three dummy adjusters each of which is detachably attached to a main leg in order to form an extension portion of the main leg and presenting an appearance similar to the adjuster body, and a main leg raising from a lower surface of a outer cylinder of the dummy adjuster to a lower end portion of the main leg is set between minimum raising of the sub leg when the leg adjuster is in a most contracted state and maximum raising of the sub leg when the leg adjuster is in a most expanded state.

Advantageous Effects of the Invention

According to the legged furniture, and the leg adjuster and the leg adjuster set for use in the same of the present invention, a work load of length adjustment of the leg of the legged furniture can be alleviated, and the usability of the legged furniture can be improved.

MODE FOR CARRYING OUT THE INVENTION

Each of embodiments of the present invention will be described below on the basis of the attached drawings.

First Embodiment

Figure 1:
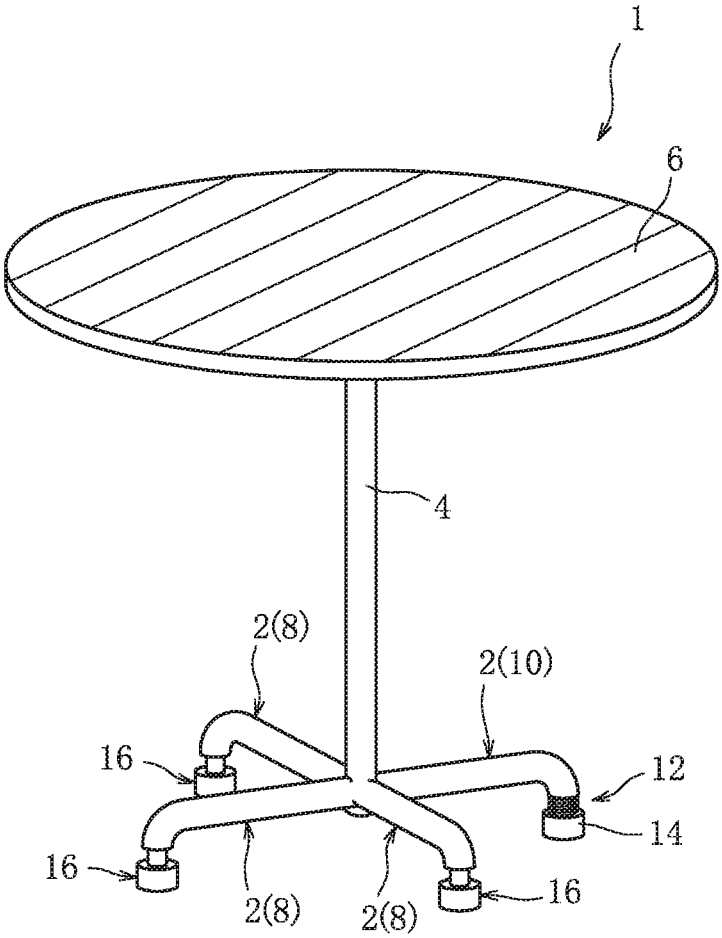
FIG. 1 is a perspective view of a table according to a first embodiment of the present invention.

FIG. 1 is a perspective view of a table (legged furniture) 1 according to a first embodiment of the present invention. This table 1 is used as a coffee table placed in a large number in a shop such as a restaurant or a cafe, for example. The table 1 has four legs 2 and a top plate (load-receiving stage) 6 supported by these legs 2 indirectly through a support 4. The four legs 2 are categorized into three main legs 8 and one sub leg 10.

The sub leg 10 includes a leg adjuster 12 forming its extension portion and capable of being expanded/contracted in a vertical direction. An adjuster body 14 of the leg adjuster 12 is detachably and easily attached to a lower end portion of the sub leg 10. Each of the main legs 8 includes a dummy adjuster 16 forming an extension portion thereof and presenting an appearance similar to the adjuster body 14 of the sub leg 10. Each of the dummy adjusters 16 is detachably and easily attached to a lower end portion of each of the main legs.

Figure 2:
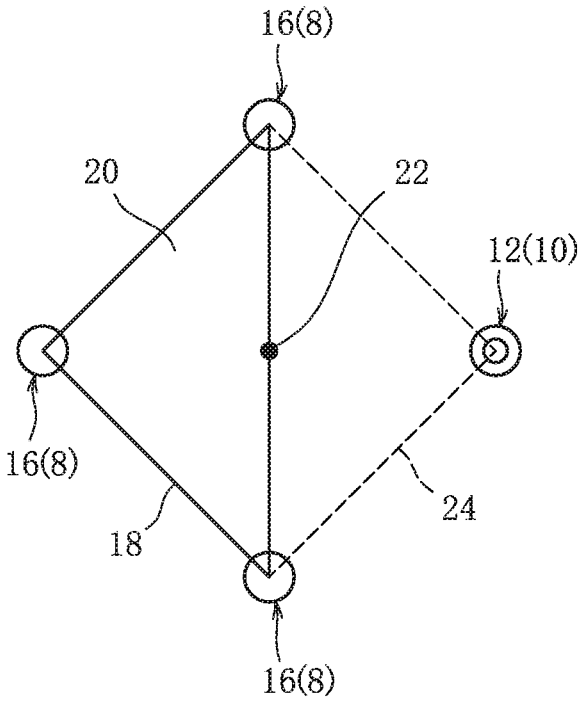
FIG. 2 is a plan view illustrating grounding positions of a leg adjuster and dummy adjusters in FIG. 1.

FIG. 2 is a plan view illustrating grounding positions of the leg adjuster 12 and the dummy adjusters 16 grounding a floor of a shop. The three main legs 8 define a triangular shape 18 by the respective dummy adjusters 16, and assuming that the table 1 is placed by using only the main legs 8, a stable stationary attitude of the table 1 can be maintained. That is, by means of the triangular surface 20 formed by grounding of the dummy adjusters 16, even if the top plate 6 is in an inclined state, not limited to the horizontal, in accordance with inclination or irregularity of the floor, the table 1 is maintained with the stable stationary attitude. If the table 1 is a coffee table for one person or the like whose area of a top surface of the top plate 6 is relatively small, even if the top plate 6 is slightly inclined, it does not hinder use of the table 1.

In the case of this embodiment, as illustrated in FIG. 2, a gravity center line 22 of the table 1 passes in the triangular shape 18 or more specifically, on the triangular shape 18. The gravity center line 22 may pass in the vicinity of the triangular shape 18. On the other hand, the three main legs 8 and one sub leg 10 define a quadrangle 24 by the leg adjuster 12 and the dummy adjusters 16.

Figure 3:
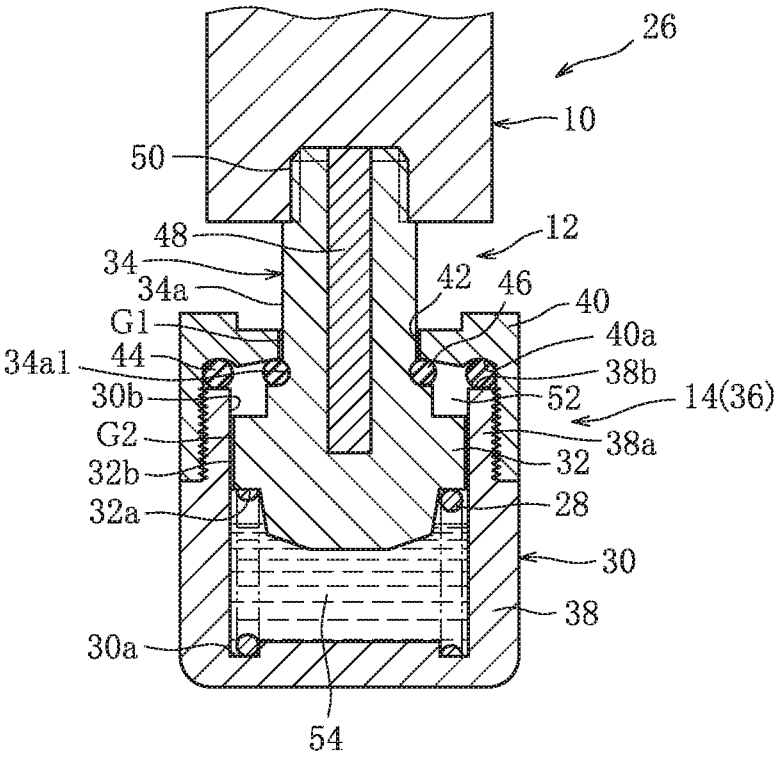
FIG. 3 is a longitudinal sectional view of the leg adjuster in FIG. 1.

FIG. 3 is a longitudinal sectional view of the leg adjuster 12. The leg adjuster 12 provides an expansion/contraction leg 26 in cooperation with the sub leg 10, while it autonomously allows expansion or contraction of the expansion/contraction leg 26 on the basis of a length of the main leg 8 in accordance with the stationary attitude of the table 1.

In detail, the leg adjuster 12 includes the aforementioned adjuster body 14 and a compression coil spring (urging means) 28 having a predetermined modulus of elasticity. The adjuster body 14 in the form of hydraulic cylinder 36 including an outer cylinder 30 as a leg end of the expansion/contraction leg 26, a piston 32 accommodated in the outer cylinder 30 and having an outer circumferential surface 32*b* forming a circular shape when seen on a cross section, and a piston rod 34 integrally formed on the piston 32 and protruding upward from the outer cylinder 30.

The outer cylinder 30 is constituted by a bottomed cylindrical member 38 with an upper end open and a cover member 40 liquid-tightly screwed with an outer circumferential wall 38*a* of the bottomed cylindrical member 38. The cover member 40 has an opening hole 42 through which the piston rod 34 is inserted, and a micro clearance (a second micro clearance) G1 is ensured between an inner circumferential surface 42*a* of the opening hole 42 and an outer circumferential surface 34*a* of the piston rod 34. By ensuring the micro clearance G1, reciprocating movement of the piston rod 34 and hence, ventilation between an inside of the outer cylinder 30 and an outside of the outer cylinder 30 with the reciprocating movement of the piston rod 34 are allowed.

Moreover, an annular outer circumferential groove 40*a* is formed in an inner corner portion of the cover member 40, and an O-ring 44 is attached in this outer circumferential groove 40*a*. The O-ring 44 is pressed by an upper end surface 38*b* of the outer circumferential wall 38*a* of the bottomed cylindrical member 38. As a result, a clearance between the bottomed cylindrical member 38 and the cover member 40, that is, an inside of the outer cylinder 30 is liquid-tightly sealed. Moreover, a circumferential groove 34*a*1 is formed immediately above the piston 32 in the outer circumferential surface 34*a* of the piston rod 34, and an O-ring 46 is attached in this circumferential groove 34*a*1. The O-ring 46 blocks the micro clearance G1 when the piston 32 rises and liquid-tightly seals the inside of the outer cylinder 30 (leakage preventing means).

An outer circumferential portion of the piston rod 34 is formed of a light-weighted material such as a synthetic resin or the like and a metal rod 48 made of an iron material or the like is pressed into an inside thereof as a reinforcing material. A male threaded portion 50 is formed at a distal end portion of the piston rod 34 protruding from the outer cylinder 30 and the threaded portion 50 is screwed into the lower end portion of the sub leg 10.

The compression coil spring 28 is accommodated in the outer cylinder 30 and is extended between a lower outer circumferential portion (lower part) 32*a* of the piston 32 and an outer circumferential groove (bottom part) 30*a* formed in a bottom of the outer cylinder 30 and urges the piston 32 to a direction in which the adjuster body 14 is expanded.

Moreover, the inside of the outer cylinder 30 is partitioned by the piston 32 into two oil chambers, an upper oil chamber (liquid chamber) 52 and a lower oil chamber (liquid chamber) 54, and the upper oil chamber 52 and the lower oil chamber 54 are filled with oil (liquid) having predetermined dynamic viscosity.

A micro clearance (first micro clearance) G2 is ensured between the outer circumferential surface 32*b* of the piston 32 and an inner circumferential surface 30*b* of the outer cylinder 30. This micro clearance G2 allows flowing of oil between the upper oil chamber 52 and the lower oil chamber 54, but a flow velocity of the oil is extremely low.

As a result, an expansion speed of the adjuster body 14 receiving an urging force of the compression coil spring 28 and a contraction speed of the adjuster body 14 against the urging force of the compression coil spring 28 are regulated to a low speed (regulating means), and the piston 32 is slowly reciprocated in a vertical direction in the outer cylinder 30 while being guided by the inner circumferential surface 30*b* of the outer cylinder 30 and thus, an impact caused by expansion/contraction of the expansion/contraction leg 26 is absorbed.

Figure 4:
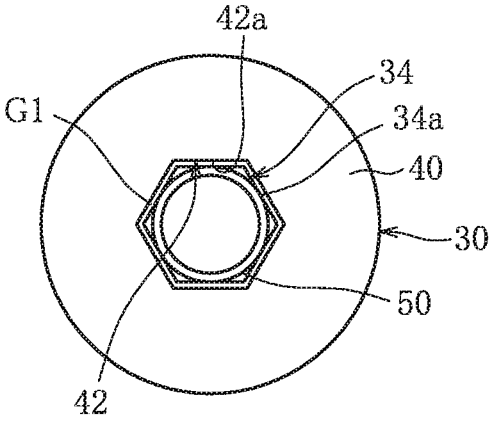
FIG. 4 is a top view of the leg adjuster in FIG. 1.

FIG. 4 is a top view of the leg adjuster 12. As illustrated in FIG. 4, the piston rod 34 has a hexagonal columnar shape other than the threaded portion 50, and the opening hole 42 is also a hexagonal hole. As a result, rotation of the outer cylinder 30 with respect to the piston rod 34 is prevented (rotation preventing means).

Figure 5:
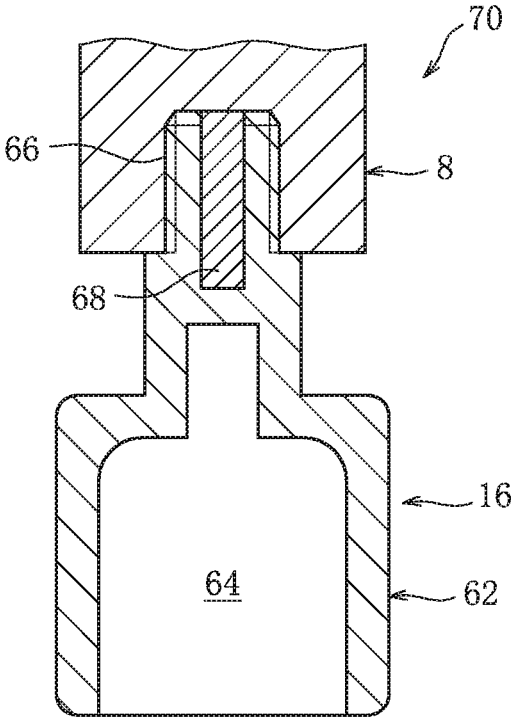
FIG. 5 is a longitudinal sectional view of the dummy adjuster in FIG. 1.

FIG. 5 is a longitudinal sectional view of the dummy adjuster 16. An outer circumferential portion of the dummy adjuster 16 forms a form of a stepped outer cylinder 62 formed of a light-weighted material such as a synthetic resin or the like. This outer cylinder 62 functions as a leg end of the main leg 8 and has a hollow portion 64 without a bottom therein. Moreover, a threaded portion 66 is integrally protruded from an upper surface of the outer cylinder 62, and this threaded portion 66 is screwed into the lower end portion of the main leg 8. Furthermore, a metal rod 68 made of an iron material or the like is pressed into an inside of this threaded portion 66 as a reinforcing material. The dummy adjuster 16 provides a reference leg 70 which collaborates with the main leg 8 and is not expanded or contracted.

Figure 6:
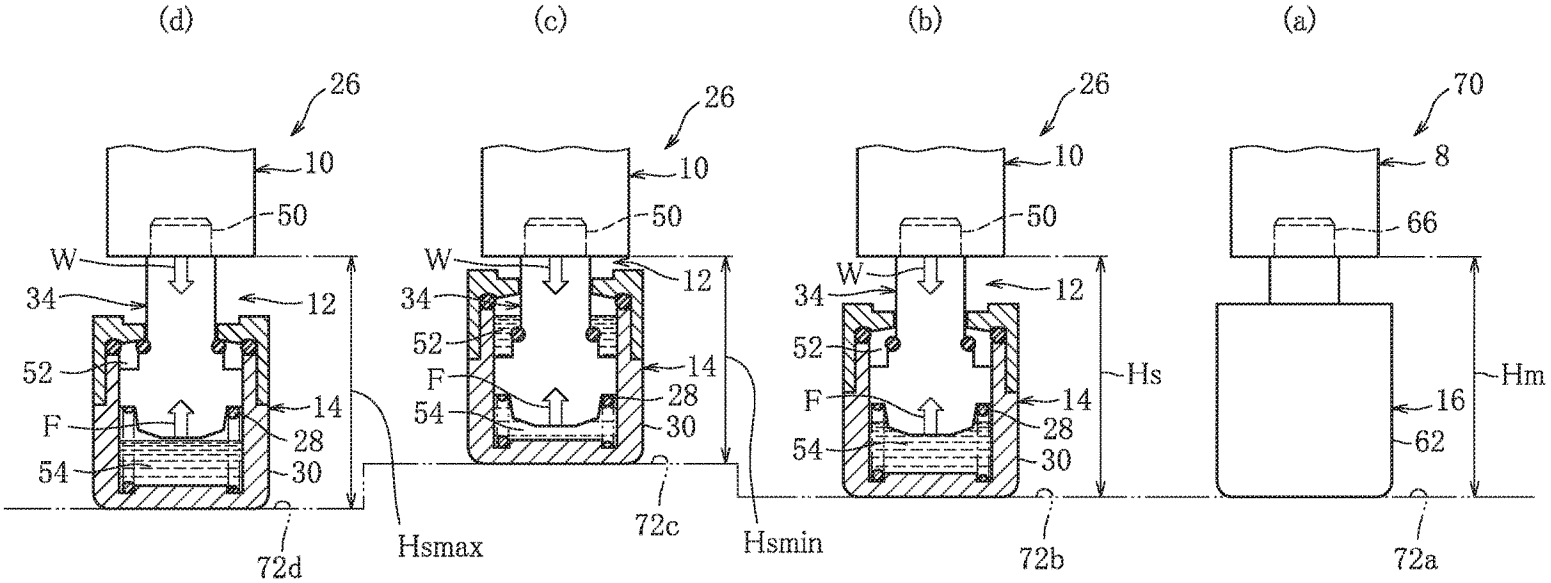
FIG. 6(*a*) is a side view of the dummy adjuster in FIG. 5, FIG. 6(*b*) is a partial sectional view illustrating an intermediate contracted state of the leg adjuster in FIG. 3, FIG. 6(*c*) is a partial sectional view illustrating a most contracted state of the leg adjuster in FIG. 3, and FIG. 6(*d*) is a partial sectional view illustrating a most expanded state of the leg adjuster.

In FIG. 6, FIG. 6(*a*) is a side view of the dummy adjuster 16, FIG. 6(*b*) is a partial sectional view illustrating an intermediate contracted state of the leg adjuster 12, FIG. 6(*c*) is a partial sectional view illustrating a most contracted state of the leg adjuster 12, and FIG. 6(*d*) is a partial sectional view illustrating a most expanded state of the leg adjuster 12. In FIGS. 6(*a*) to 6(*d*), floor surfaces 72*a* to 72*d* on which the leg adjuster 12 and the dummy adjuster 16 are grounded are indicated by a two-dot chain line. Moreover, in FIGS. 6(*a*) to 6(*d*), the floor surfaces 72*a* to 72*d* are all described as if they are horizontal, but a case where the triangular surface 20 is inclined with respect to a horizontal surface can be also assumed.

First, as illustrated in FIGS. 6(*a*) and 6(*b*), assume that a floor surface 72*b* on which one leg adjuster 12 is grounded and a floor surface 72*a* on which the three dummy adjusters 16 are grounded are flush with each other. In this case, the triangular surface 20 is defined by the three main legs 8 on the floor surface 72*a*, whereby a stationary attitude of the table 1 is ensured. And the expansion/contraction leg 26 is autonomously expanded or contracted on the basis of the length of the main leg 8 in accordance with the stationary attitude of this table 1, whereby the leg adjuster 12 is grounded on the floor surface 72*b* flush with the triangular surface 20. At this time, the compression coil spring 28 is settled in the intermediate contracted state in terms of its natural length, and an urging force F and a load W indicated in FIG. 6(*b*) act on the expansion/contraction leg 26.

The urging force F is a force urging the piston 32 upward by the oil retaining in the lower oil chamber 54 in the outer cylinder 30 and the compression coil spring 28. The load W is an assumed load (load on the basis of weights of the top plate 6 itself, an article on the top plate 6, the sub leg 10 and the like) applied to the leg adjuster 12 from the top plate 6 side.

Subsequently, as illustrated in FIGS. 6(*a*) and 6(*c*), assume that a floor surface 72*c* on which one leg adjuster 12 is grounded is at a highest position from the floor surface 72*a* on which the three dummy adjusters 16 are grounded. In this case, too, the triangular surface 20 is defined by the three main legs 8 on the floor surface 72*a*, whereby the stationary attitude of the table 1 is ensured. And the expansion/contraction leg 26 is autonomously expanded or contracted on the basis of the length of the main leg 8 in accordance with the stationary attitude of this table 1, whereby the leg adjuster 12 is grounded on the floor surface 72*c* which is the highest from the triangular surface 20. At this time, the compression coil spring 28 is settled in a most contracted state in terms of its natural length, and the urging force F and the load W act on the expansion/contraction leg 26.

Subsequently, as illustrated in FIGS. 6(*a*) and 6(*d*), assume that a floor surface 72*d* on which one leg adjuster 12 is grounded is at a lowest position from the floor surface 72*a* on which the three dummy adjusters 16 are grounded. In this case, too, the triangular surface 20 is defined by the three main legs 8 on the floor surface 72*a*, whereby the stationary attitude of the table 1 is ensured. And the expansion/contraction leg 26 is autonomously expanded or contracted on the basis of the length of the main leg 8 in accordance with the stationary attitude of this table 1, whereby the leg adjuster 12 is grounded on the floor surface 72*d* which is the lowest from the triangular surface 20. At this time, the compression coil spring 28 is settled in a most expanded state in terms of its natural length, and the urging force F and the load W act on the expansion/contraction leg 26.

On the other hand, a distance from the lower surface of the outer cylinder 62 of the dummy adjuster 16 to the lower end portion of the main leg 8 is defined as a main leg raising Hm (see FIG. 6(*a*)). Moreover, a distance from the lower surface of the outer cylinder 30 in the adjuster body 14 to the lower end portion of the sub leg 10 is defined as a sub leg raising Hs (see FIG. 6(*b*)) when the leg adjuster 12 is in the intermediate contracted state.

At this time, the main leg raising Hm is set between a minimum raising Hsmin (see FIG. 6(*c*)) of the sub leg 10 when the leg adjuster 12 is in the most contracted state and a maximum raising Hsmax (see FIG. 6(*d*)) of the sub leg 10 when the leg adjuster 12 is in the most expanded state. Preferably, the main leg raising Hm is set between the minimum raising Hsmin and the maximum raising Hsmax.

The main leg raising Hm, the sub leg raising Hs, the minimum raising Hsmin of the sub leg 10, the maximum raising Hsmax of the sub leg 10, modulus of elasticity of the compression coil spring 28, dynamic viscosity of the oil, sizes of the micro clearances G1 and G2 and the like are set as appropriate in accordance with adjusting performances of the leg adjuster 12 required for the table 1.

As described above, in this embodiment, the expansion/contraction leg 26 collaborating with the sub leg 10 by the leg adjuster 12 of the sub leg 10 is provided while the stable stationary attitude of the table 1 is made possible by the three main legs 8 defining the triangular shape 18, and expansion or contraction of the expansion/contraction leg 26 based on the length of the main leg 8 can be autonomously allowed in accordance with the stationary attitude of the table 1. Therefore, a work load of length adjustment of the leg 2 of the table 1 can be alleviated, and the usability of the table 1 can be improved.

Specifically, rattling of the table 1 after rearrangement can be prevented at all times even without considering a place for arranging each table or a grounding position of each leg of the table before floor cleaning or refurbishment. Therefore, readjustment of the length of the leg 2 of the table 1 is no longer needed, spilling of drink from a container which is a cup, a glass or the like on the table surface due to rattling of the table 1 or hindrance with a work performed on the table 1 can be suppressed, and the table 1 with good usability and thus, a comfortable shop environment can be provided to customers.

Here, assume that the table 1 is the table 1 with three legs, that is, the table 1 having only three main legs 8. Even in this case, the top plate 6 is supported at three points by the three main legs and the triangular shape 18 is defined and thus, even if there is inclination or rattling on the floor, the stable stationary attitude of the table 1 can be maintained. However, in the table 1 with three-point support, it is likely that a load of an article on the top plate 6 by a customer using the table 1 or a load applied to the top plate by an elbow of the customer changes the position of the gravity center line 22 of the table 1, and this gravity center line 22 passes through a spot extremely far from the triangular shape 18 and thus, the top plate 6.

However, by providing four legs 2 as in this embodiment and by further providing the expansion/contraction leg 26 as one of the legs 2, as illustrated in FIG. 2, the three main legs 8 and the one sub leg 10 define the quadrangle 24, and the table 1 is supported at four points. That is, the quadrangle 24 having an area larger than that of the triangular shape 18 can be defined by each of the legs 2.

Depending on a structure and a use environment of the table 1, even if the gravity center line 22 passes through a spot far from the triangular shape 18, a possibility that the gravity center line 22 passes in the quadrangle 24 or in the vicinity of the quadrangle 24 having an area larger than that of the triangular shape 18 becomes high. Therefore, on the premise of the table 1 including four or more of legs 2, the present invention can reliably maintain the stable stationary attitude of the table 1 even if the top plate 6 enters a state inclined from the horizontal in accordance with inclination or irregularity of the floor.

Moreover, by means of the aforementioned micro clearance G2, the expansion speed of the adjuster body 14 having received the urging force of the compression coil spring 28 and the contraction speed of the adjuster body 14 against the urging force of the compression coil spring 28 can be regulated. Therefore, since expansion or contraction of the expansion/contraction leg 26 is carried out slowly, rattling of the table 1 can be prevented without giving a sense of discomfort to the customer using the table, and more comfortable shop environment can be provided to the customer.

Moreover, the main leg raising Hm is set between the minimum raising Hsmin of the sub leg and the maximum raising Hsmax of the sub leg. As a result, both the expansion range and the contraction range of the expansion/contraction leg 26 based on the length of the main leg 8 can be reliably ensured in accordance with an inclination direction or irregularity of the floor. Therefore, whatever the mode of an inclination gradient or irregularity of the floor is, rattling of the table 1 can be effectively prevented. Since the main leg raising Hm is set to a position between the minimum raising Hsmin and the maximum raising Hsmax, the expansion/contraction range of the expansion/contraction range can be divided equally to the expansion side and the contraction side. Therefore, expansion or contraction of the expansion/contraction leg 26 can be carried out to the same degree in accordance with the inclination direction or irregularity of the floor, and rattling of the table 1 can be prevented more effectively.

Moreover, the gravity center line 22 of the table 1 passes in the triangular shape 18 defined by the three main legs 8. As a result, except the case where the gravity center line 22 is extremely separated far from the triangular shape 18 and goes out of it depending on the use environment of the table 1, a change of the gravity center line 22 is small, and an expansion/contraction frequency of the expansion/contraction leg 26 and hence, an operation frequency of the leg adjuster 12 can be reduced. Therefore, the stable stationary attitude of the table 1 can be maintained further reliably.

Moreover, in the piston rod 34, those other than the threaded portion 50 have hexagonal columnar shapes, and the opening hole 42 is also a hexagonal hole. That is, the inner circumferential surface 42*a* of the opening hole 42 and the outer circumferential surface 34*a* of the piston rod 34 form a hexagonal shape having the micro clearance G1 when seen on a cross section. As a result, rotation of the outer cylinder 30 with respect to the piston rod 34 can be prevented.

Thus, when the outer cylinder 30 is rotated by using a wrench or the like, not shown, idling of the outer cylinder 30 with respect to the piston rod 34 is prevented, and the threaded portion 50 can be easily screwed to the sub leg 10 and can be connected. Therefore, the work load of the length adjustment of the legs of the table 1 can be alleviated, and the usability can be further improved. The inner circumferential surface 42*a* of the opening hole 42 and the outer circumferential surface 34*a* of the piston rod 34 are not limited to hexagonal shapes but may be other polygonal shapes or ovals, and the similar effect can be obtained by any shape other than a perfect circle.

Second Embodiment

By referring to FIGS. 7A to 13D, constitution of a leg adjuster 100 and a dummy adjuster 130 according to a second embodiment of the present invention, different from the first embodiment will be mainly described. For the constitution similar to the first embodiment, the same reference numerals as those in the first embodiment are given in the drawings or described in Description with the same names as in the first embodiment or the like and explanation might be omitted.

Figure 7A:
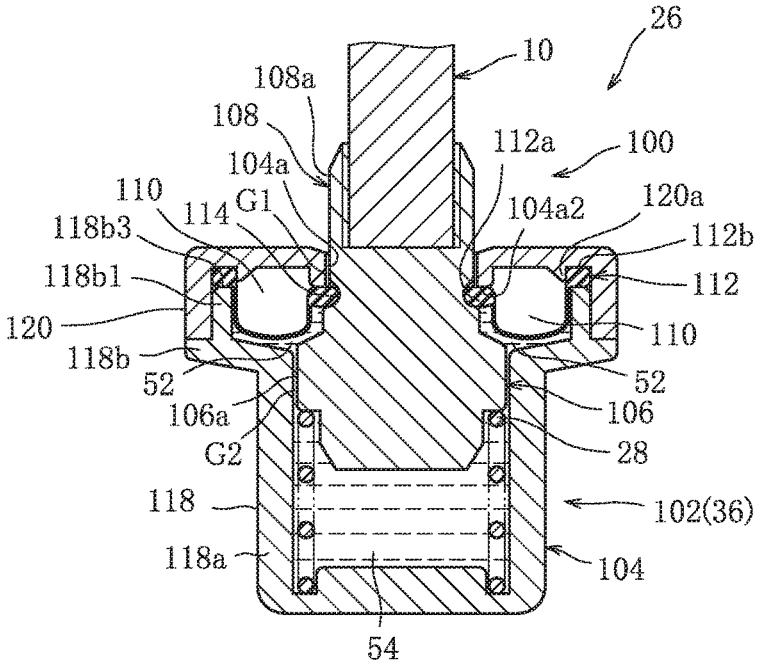
FIG. 7A is a longitudinal sectional view illustrating a most expanded state of the leg adjuster according to a second embodiment of the present invention.
Figure 7B:
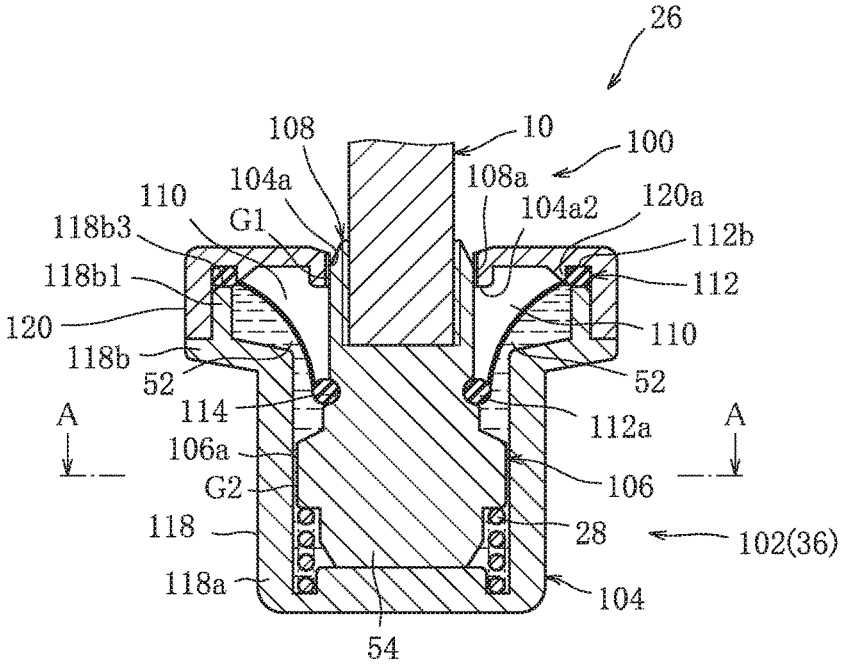
FIG. 7B is a longitudinal sectional view illustrating a most contracted state of the leg adjuster in FIG. 7A.
Figure 8A:
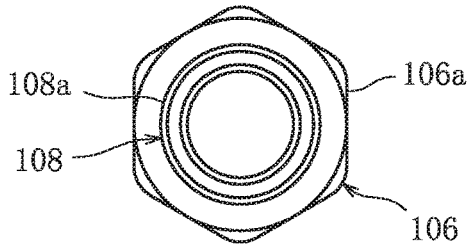
FIG. 8A is a top view of a piston in FIG. 7A.
Figure 8B:
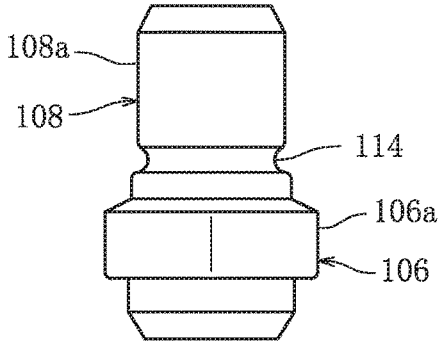
FIG. 8B is a side view of a piston in FIG. 8A.
Figure 8C:
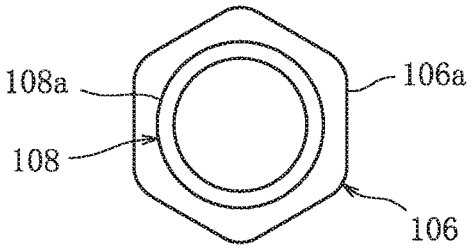
FIG. 8C is a bottom view of a piston in FIG. 8A.
Figure 8D:
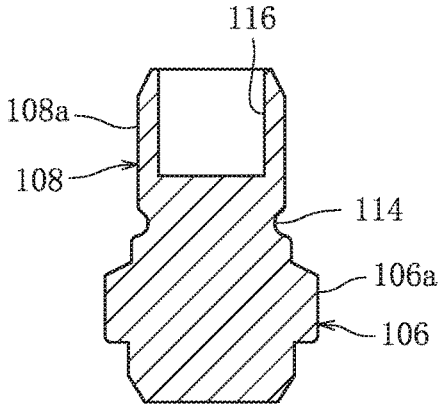
FIG. 8D is a longitudinal sectional view of a piston in FIG. 8A.

As illustrated in FIGS. 7A and 7B, the leg adjuster 100 includes an adjuster body 102 and a compression coil spring (urging means) 28. The leg adjuster 100 in the form of hydraulic cylinder 36 form similarly to the leg adjuster 12 in the first embodiment, and the expansion speed of the adjuster body 102 receiving the urging force of the compression coil spring 28 and the contraction speed of the adjuster body 102 against the urging force of the compression coil spring 28 are regulated to low speeds (regulating means).

The adjuster body 102 includes an outer cylinder 104 as a leg end of the expansion/contraction leg 26, a piston 106 accommodated in the outer cylinder 104, and a piston rod 108 integrally formed on the piston 106 and protruding from an opening hole 104*a* of the outer cylinder 104. The adjuster body 102 includes a seal member 112 forming a space 110 on the micro clearance G1 side by partitioning an inside of the outer cylinder 104 from the upper oil chamber 52 on the piston rod 108 side.

As illustrated in FIGS. 8A to 8D, the piston 106 has an outer circumferential surface 106*a* forming a hexagon when seen on a cross section. On the other hand, the piston rod 108 generally forms a columnar shape, and an outer circumferential surface 108*a* of the piston rod 108 has a circular shape when seen on a cross section. Moreover, a circumferential groove 114 by which an inner end 112*a* which will be described later of the seal member 112 is locked is formed immediately above the piston 106 of the outer circumferential surface 108*a*. Moreover, a female threaded portion 116 is opened and internally provided at a distal end portion of the piston rod 108 protruding from the outer cylinder 104, and the lower end portion of the sub leg 10 is screwed into the threaded portion 116.

Figure 9A:
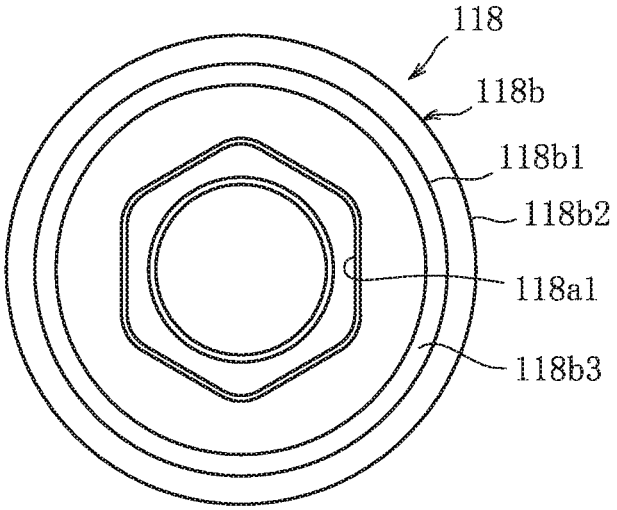
FIG. 9A is a top view of a bottomed cylindrical member of an outer cylinder in FIG. 7A.
Figure 9B:
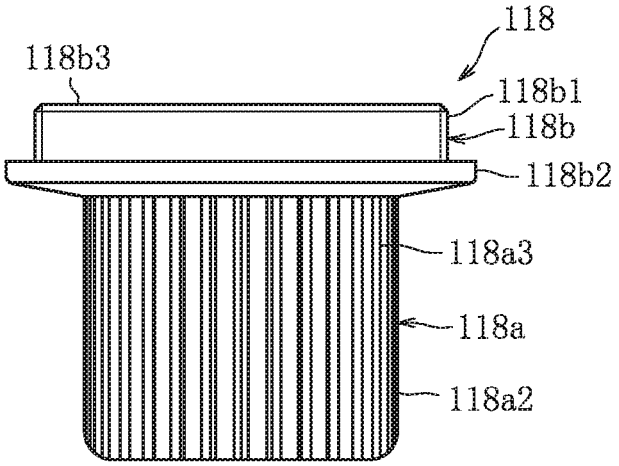
FIG. 9B is a side view of a bottomed cylindrical member in FIG. 9A.
Figure 9C:
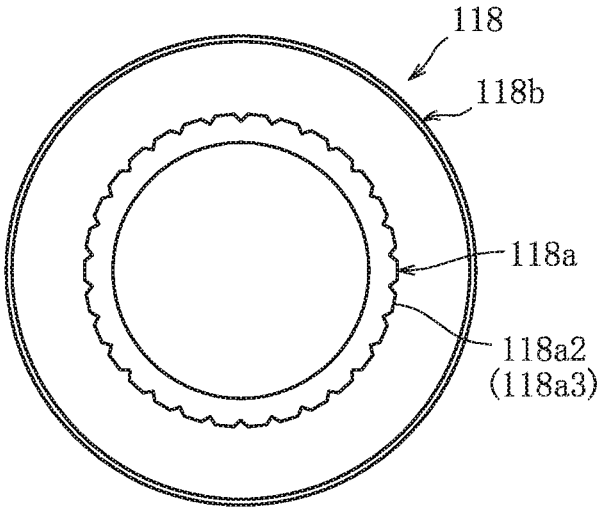
FIG. 9C is a bottom view of a bottomed cylindrical member in FIG. 9A.
Figure 9D:
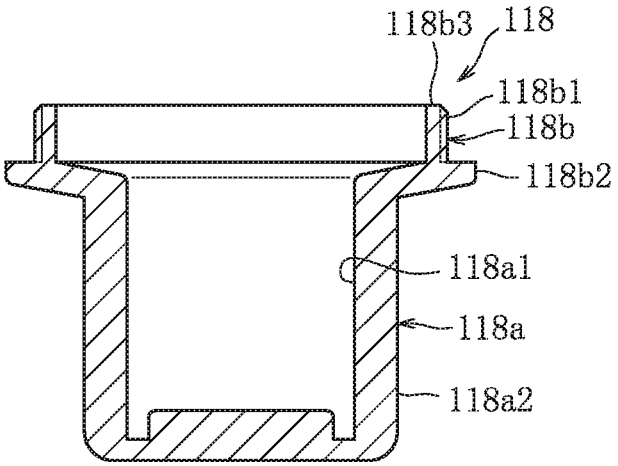
FIG. 9D is a longitudinal sectional view of a bottomed cylindrical member in FIG. 9A.

As illustrated in FIGS. 9A and 9D, a bottomed cylindrical member 118 of the outer cylinder 104 forms a stepped form of a small-diameter portion 118*a* and a large-diameter portion 118*b* positioned on an upper side of the small-diameter portion 118*a* and having a diameter larger than that of the small-diameter portion 118*a*. An inside of the small-diameter portion 118*a* is divided into each of the oil chambers 52 and 54 of the hydraulic cylinder 36, and an inner circumferential surface 118*a*1 forming a hexagonal shape when seen on a cross section is formed. Moreover, a large number of biting teeth 118*a*3 forming a linear shape in a height direction of the bottomed cylindrical member 118 are formed by serration work or the like on an outer circumferential surface 118*a*2 of the small-diameter portion 118*a*.

On the other hand, the large-diameter portion 118*b* has a cylindrical cylinder portion 118*b*1 to which a cover member 120 of the outer cylinder 104 is fitted or screwed and attached and a flange portion 118*b*2 with which a lower end of the cover member 120 is brought into contact with attachment of the cover member 120. Moreover, an upper end surface 118*b*3 of the cylinder portion 118*b*1 is also separated from the cover member 120 by attachment of the cover member 120 to the large-diameter portion 118*b*. Furthermore, the large-diameter portion 118*b* has a volume allowing expansion/contraction of the seal member 112 caused by reciprocating movement of the piston rod 108 with respect to the outer cylinder 104.

Figure 10:
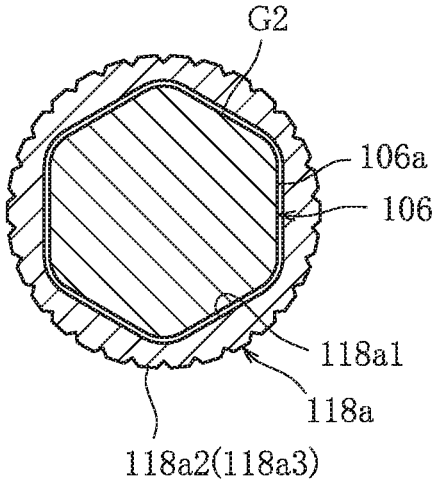
FIG. 10 is a sectional view of the leg adjuster when seen from an A-A direction in FIG. 7B.
Figure 11A:
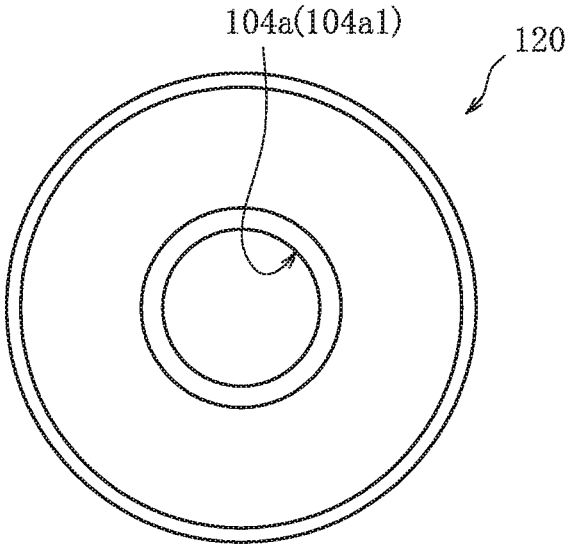
FIG. 11A is a top view of a cover member of the outer cylinder in FIG. 7A.
Figure 11B:
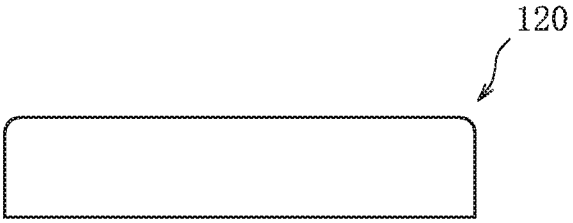
FIG. 11B is a side view of the cover member in FIG. 11A.
Figure 11C:
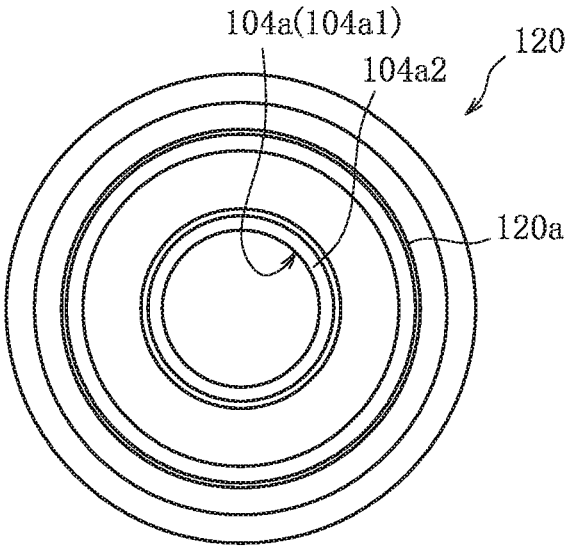
FIG. 11C is a bottom view of the cover member in FIG. 11A.
Figure 11D:
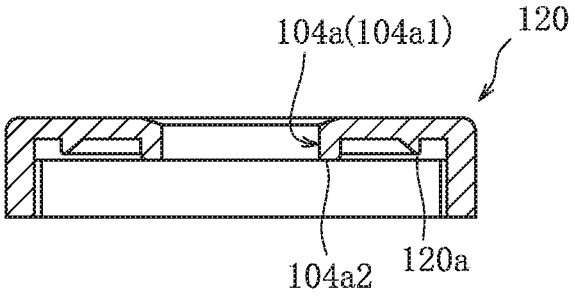
FIG. 11D is a longitudinal sectional view of the cover member in FIG. 11A.

As illustrated in FIG. 10, the outer circumferential surface 106*a* of the piston 106 and the inner circumferential surface 118*a*1 of the small-diameter portion 118*a* in which the piston 106 is accommodated both form a hexagonal shape having the micro clearance G2 when seen from a cross section. As a result, rotation of the outer cylinder 104 with respect to the piston 106 is prevented (rotation preventing means). Therefore, when a wrench or the like, not shown, is caused to bite into biting teeth so as to rotate the outer cylinder 104, idling of the outer cylinder 104 with respect to the piston 106 is prevented, and the threaded portion 116 can be easily screwed and connected to the sub leg 10.

As illustrated in FIGS. 11A to 11D, the cover member 120 of the outer cylinder 104 forms a cap shape, and the aforementioned opening hole 104*a* through which the piston rod 108 is inserted is formed at a center thereof. The opening hole 104*a* has a circular inner circumferential surface 104*a*1 when seen from a cross section and a lower end surface 104*a*2 continuing to the inner circumferential surface 104*a*1. Moreover, an annular locking claw 120*a* protrudes by locking an outer end 112*b* which will be described later of the seal member 112 in the vicinity of an inner corner portion of the cover member 120. Then, by attaching the cover member 120 to the large-diameter portion 118*b*, the substantially flush outer circumferential surface of the outer cylinder 104 is formed on the large-diameter portion 118*b* and the cover member 120.

Figure 12A:
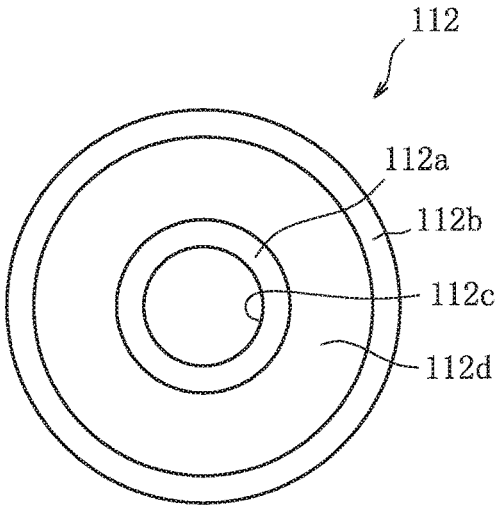
FIG. 12A is a top view of a seal member in FIG. 7A.
Figure 12B:
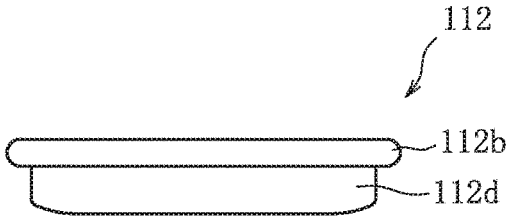
FIG. 12B is a side view of the seal member in FIG. 12A.
Figure 12C:
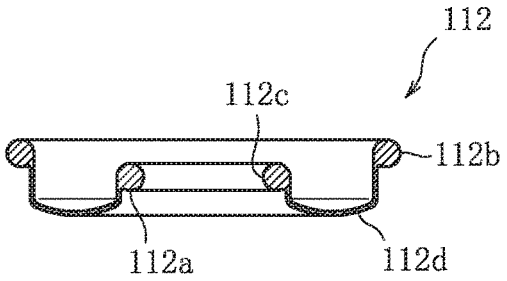
FIG. 12C is a longitudinal sectional view of the seal member in FIG. 12A.
Figure 13A:
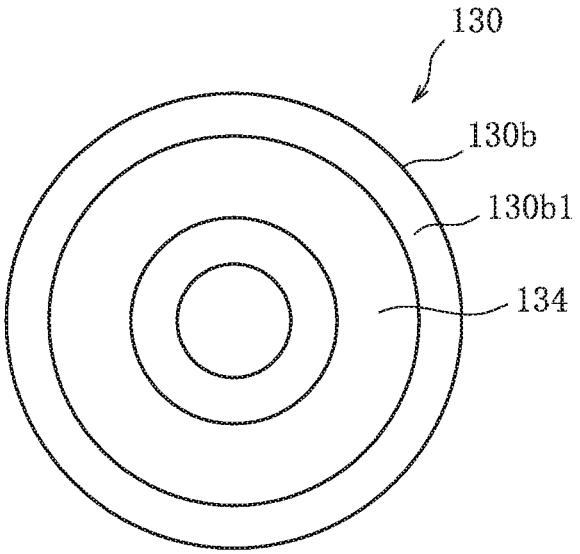
FIG. 13A is a top view of a dummy adjuster according to the second embodiment of the present invention.
Figure 13B:
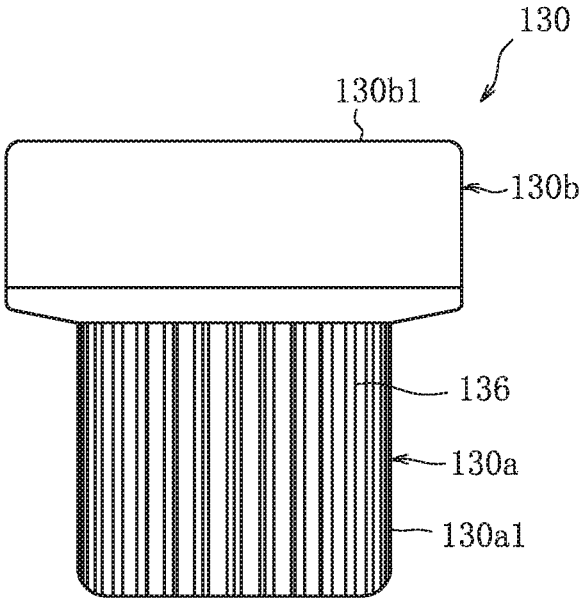
FIG. 13B is a side view of the dummy adjuster in FIG. 13A.
Figure 13C:
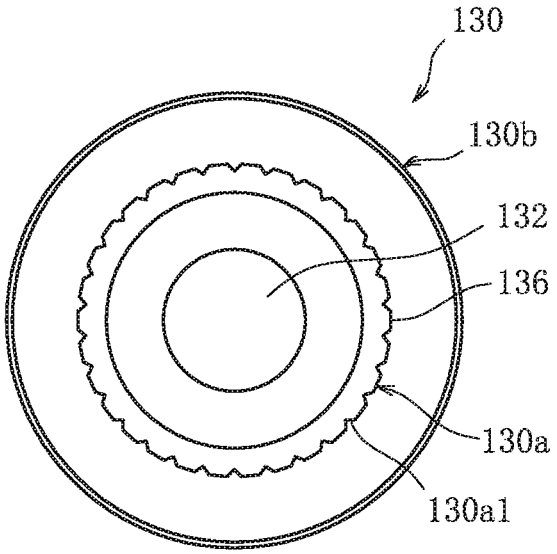
FIG. 13C is a bottom view of the dummy adjuster in FIG. 13A.
Figure 13D:
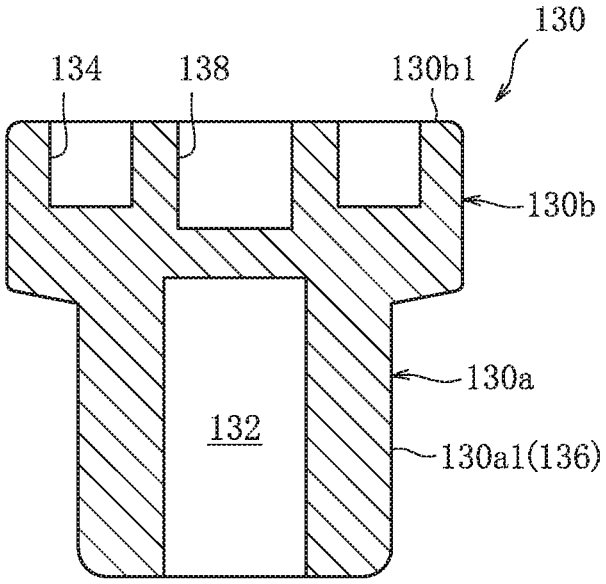
FIG. 13D is a longitudinal sectional view of the dummy adjuster in FIG. 13A.

As illustrated in FIGS. 12A to 12C, the seal member 112 is integrally formed of an elastic body having elasticity such as rubber, having an annular band shape. The seal member 112 has the inner end 112*a* having a circular section forming an opening hole 112*c*, an outer end 112*b* having a circular section forming an outer edge of the seal member 112, and a thin expansion/contraction portion 112*d* connecting the inner end 112*a* and the outer end 112*b*.

As illustrated in FIGS. 7A and 7B, with attachment of the cover member 120 to the large-diameter portion 118*b*, the outer end 112*b* of the seal member 112 is crushed and locked by a locking claw 120*a* of the cover member 120 and an upper end surface 118*b*3 of the cylinder portion 118*b*1 of the large-diameter portion 118*b*. As a result, in both of rising and lowering of the piston 106, a clearance between the bottomed cylindrical member 118 and the cover member 120 is blocked by the outer end 112*b* at all times.

As illustrated in FIG. 7A, the inner end 112*a* also rises with the rise of the piston 106, and the volume of the space 110 is reduced by contraction of the expansion/contraction portion 112*d*, whereby air in the space 110 is discharged through the micro clearance G1. Then, when the piston 106 rises to the maximum, the inner end 112*a* is pressed by the lower end surface 104*a*2 of the opening hole 104*a* and blocks the micro clearance G1.

On the other hand, as illustrated in FIG. 7B, the inner end 112*a* also lowers with lowering of the piston 106, and the volume of the space 110 is increased by expansion of the expansion/contraction portion 112*d*, whereby the air flows into the space 110 through the micro clearance G1. At this time, too, the inner end 112*a* is locked by the circumferential groove 114 of the piston rod 108. As described above, since expansion/contraction between the inner end 112*a* and the outer end 112*b* is allowed by the expansion/contraction portion 112*d* in the seal member 112, though the volume of the space 110 is increased/decreased by ventilation through the micro clearance G1, the space 110 maintains separation between the upper oil chamber 52 and the micro clearance G1.

As illustrated in FIGS. 13A to 13D, an outer circumferential portion of the dummy adjuster 130 forms a stepped outer cylinder form of a small-diameter portion 130*a* and a large-diameter portion 130*b* similar to the leg adjuster 100. This outer cylinder functions as a leg end of the main leg 8 and has a hollow portion 132 without a bottom inside the small-diameter portion 130*a*, and a circumferential groove 134 having an annular band shape is formed in an upper end surface 130*b*1 of the large-diameter portion 130*b*.

The dummy adjuster 130 is thinned by the hollow portion 132 and the circumferential groove 134 and has its weight reduced. Moreover, biting teeth 136 similar to the leg adjuster 100 are formed on an outer circumferential surface 130*a*1 of the small-diameter portion 130*a*. Moreover, a threaded portion 138 is opened in the upper end surface 130*b*1 of the large-diameter portion 130*b*, and the lower end portion of the main leg 8 is screwed into this threaded portion 138. Then, the dummy adjuster 130 provides a reference leg which is not expanded/contracted in cooperation with the main leg 8.

As described above, in this embodiment, similarly to the first embodiment, the work load of length adjustment of the leg 2 of the table 1 can be alleviated, and the usability of the table 1 can be improved.

Particularly, in the case of this embodiment, the outer circumferential surface 106*a* of the piston 106 and the inner circumferential surface 118*a*1 of the small-diameter portion

118*a* in which the piston 106 is accommodated form a hexagonal shape having the micro clearance G2 when seen on a cross section.

In this case, when the outer cylinder 104 is rotated by using a wrench or the like, a rotating spot of the outer cylinder 104 and an engaging spot between the outer cylinder 104 and the piston 106 can be positioned closer to each other with the outer cylinder 104 between them. As a result, as compared with the case where the piston rod 34 and the opening hole 42 have hexagonal shapes as in the first embodiment, the outer cylinder 104 can be screwed and connected to the piston 106 further smoothly while rattling of the outer cylinder 104 is prevented. Therefore, the work load of length adjustment of the leg 2 of the table 1 can be further alleviated. The outer circumferential surface 106*a* of the piston 106 and the inner circumferential surface 118*a*1 of the small-diameter portion 118*a* are not limited to hexagonal shapes but may be other polygonal shapes or ovals, and the similar effect can be obtained by any shape other than a perfect circle.

Moreover, by providing the seal member 112, the space 110 maintaining separation between the upper oil chamber 52 and the micro clearance G1 can be formed in the outer cylinder 104 at all times while the clearance between the bottomed cylindrical member 118 and the cover member 120 is blocked by the outer end 112*b* at all times. Thus, as compared with the case where the O-rings 44 and 46 are provided in the first embodiment, the inside of the outer cylinder 104 can be liquid-tightly sealed further reliably.

Specifically, in the outer cylinder 104, when the piston 106 is at a position in the middle of rising, when the piston 106 is at a position in the middle of lowering or when the piston 106 is at a position lowered to the maximum, even if the table 1 is inclined during length adjustment of the leg 2 of the table 1, leakage of the oil in the upper oil chamber 52 through the micro clearance G1 can be reliably prevented. Therefore, since there is no need to concern about oil leakage during length adjustment of the leg 2 of the table 1, the work load during the adjustment can be further alleviated.

Moreover, by forming the outer cylinder 104 by the small-diameter portion 118*a* in which each of the oil chambers 52 and 54 are formed and the large-diameter portion 118*b* in which the space 110 is formed, expansion/contraction of the seal member 112 in the outer cylinder 104 with the reciprocating movement of the piston 106 is smoothly carried out in a region including not only a height direction of the outer cylinder 104 but also a radial direction of the outer cylinder 104 while a dimension in the height direction of the outer cylinder 104 is reduced.

As a result, size reduction in the height direction of the outer cylinder 104 and hence, the adjuster body 102 can be realized. Therefore, since it is not necessary to lift the table 1 extremely higher during length adjustment of the leg 2 of the table 1, the working load can be further alleviated. Moreover, since the height of the existing table 1 has drastically changed by mounting the adjuster body 102, a sense of discomfort is prevented from being given to the customer using the table 1, and the usability of the table 1 can be further improved.

The present invention is not limited to each of the aforementioned embodiments but is capable of various variations.

For example, the table 1 having the four legs 2 is described in each of the aforementioned embodiments but as described above, the present invention can be applied even if the table 1 has five or more legs 2.

Figure 14:
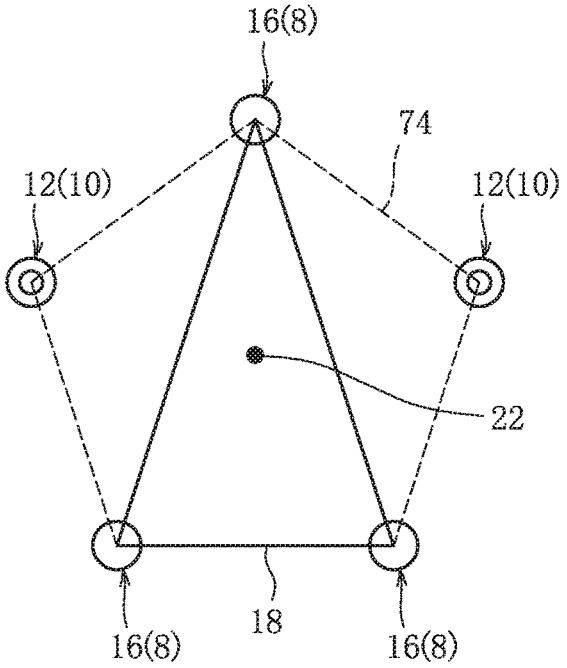
FIG. 14 is a plan view illustrating grounding positions of the leg adjusters and the dummy adjusters according to a variation of the present invention.

Specifically, as illustrated in FIG. 14, in the case of the table 1 having the five legs 2, it is only necessary that the triangular shape 18 defined by the three main legs 8 is positioned at a center in a pentagonal shape 74 defined by each of the legs 2, and the remaining legs 2 are made the sub legs 10.

Figure 15:
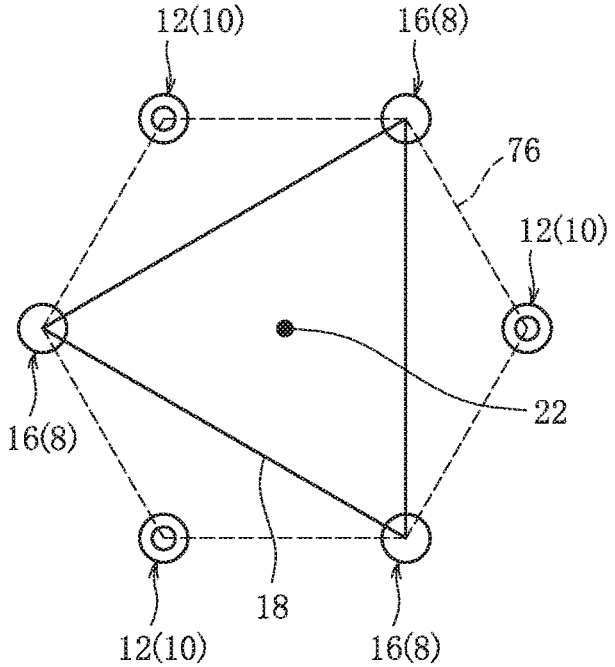
FIG. 15 is a plan view illustrating grounding positions of the leg adjusters and the dummy adjusters according to another variation of the present invention.

Moreover, as illustrated in FIG. 15, in the case of the table 1 having six legs 2, it is only necessary that the triangular shape 18 defined by the three main legs 8 is positioned at a center of a hexagonal shape 76 defined by each of the legs 2, and the remaining legs 2 are made the sub legs 10. The triangular shape 18 may be defined with an apex different from those in FIGS. 14 and 15. However, in the case of FIGS. 14 and 15, as illustrated in these drawings, since the gravity center line 22 of the table 1 passes in the triangular shape 18 defined by the main legs 8, stability of the table 1 is increased as described above, which is suitable.

Moreover, the novel table 1 to which the present invention is applied is described in each of the aforementioned embodiments, but the expansion/contraction leg 26 may be formed by cutting and reducing the length of a leg of an existing table and by attaching the leg adjuster 12 to the shortened leg. In this case, preparation of at least only the leg adjuster 12 formed of the adjuster body 14 having an orifice in the outer cylinder 30 and the compression coil spring 28 is sufficient. The remaining legs can be used as they are as the main legs 8 without cutting. As described above, by preparing only the leg adjuster 12, the present invention can be applied to the existing table having four or more legs 2, and the working effect similar to the case where the novel table 1 is formed can be obtained.

Moreover, it may be so constituted that a leg adjuster set combining one leg adjuster 12 and three dummy adjusters 16 is prepared, and the leg adjuster 12 constituting the one or a plurality of the leg adjuster sets and the dummy adjuster 16 are attached to each leg 2 of the existing table, respectively. In this case, by preparing only the leg adjuster set, the present invention can be applied to the existing table having four or more legs 2, and the working effect similar to the case where the novel table 1 is formed can be obtained.

Moreover, in each of the aforementioned embodiments, the compression coil spring 28 is used for urging the adjuster body 14 in the expanding direction, but other urging means, that is, an elastic member such as rubber, for example, may be used instead of the compression coil spring 28.

Moreover, in each of the aforementioned embodiments, in order to regulate the expansion speed of the adjuster body 14 having received the urging force of the compression coil spring 28 and the contraction speed of the adjuster body 14 against the urging force of the compression coil spring 28, the micro clearance G2 is ensured. However, regulating means other than this micro clearance G2 may be used, and a micro hole penetrating the piston 32 may be formed and made to function as an orifice, for example.

Moreover, in each of the aforementioned embodiments, the adjuster body 14 is in the form of hydraulic cylinder 36 using the oil as a working fluid. However, not limited to the oil but various types of fluids can be assumed for the working fluid as long as it is a viscous fluid. Moreover, it can be applied also to a gas pressure cylinder using a gas.

Moreover, in each of the aforementioned embodiments, the top plate 6 of the table 1 is supported by the legs 2 indirectly through the support 4. However, the present invention can be applied also to a table in which each of the legs 2 extends directly from the lower surface of the top plate 6 and the top plate 6 is supported directly by each of the legs 2.

Figure 16:
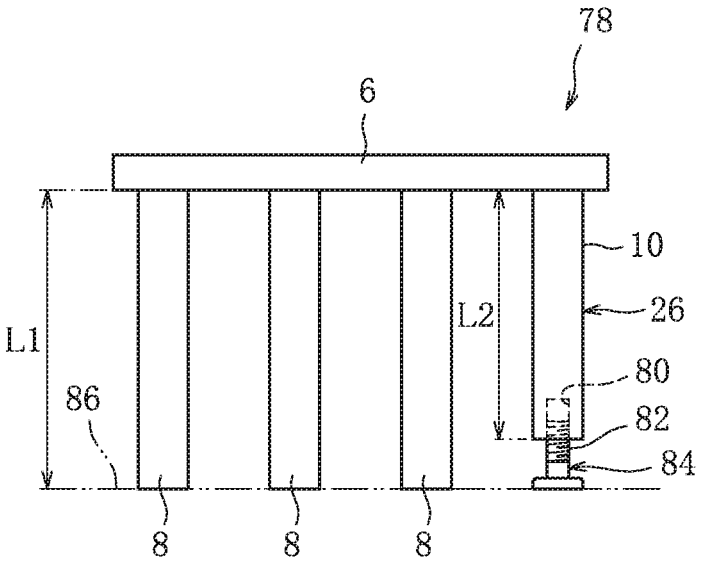
FIG. 16 is a side view of a table according to the variation of the present invention.

Specifically, as illustrated in FIG. 16, a table 78 is formed by connecting three main legs 8 each having a length L1 and the sub leg 10 having a length L2 shorter than L1 to the top plate 6. A screw hole 80 is formed in the lower end portion of the sub leg 10, and a leg adjuster 84 having a threaded portion 82 at a distal end is screwed to this screw hole 80.

Then, by manually adjusting a height of the leg adjuster 84, the sub leg 10 may be brought into contact as the expansion/contraction leg 26 with a floor surface 86. Even in this case, as illustrated in FIG. 2, the stable stationary attitude of the table 78 can be maintained by using only the three main legs 8 defining the triangular shape 18. The leg adjuster 84 can be applied also to a table having a number of legs 2 illustrated in FIG. 14 or FIG. 15.

Moreover, it is needless to say that the present invention can be applied not only to a table but also to furnishings including a chair and legged furnitures in general including a stool such as a step-ladder and a load receiving stage.

EXPLANATION OF REFERENCE SIGNS

1, 78 table (legged furniture)
2 leg
6 top plate (load-receiving stage)
8 main leg
10 sub leg
12, 84, 100 leg adjuster
14, 102 adjuster body
16, 130 dummy adjuster
18 triangular shape
22 gravity center line
26 expansion/contraction leg
28 compression coil spring (urging means)
30, 104 outer cylinder
118*a* small-diameter portion
118*b* large-diameter portion
30*a* outer circumferential groove (bottom part)
30*b* inner circumferential surface
32, 106 piston
32*a* lower outer circumferential portion (lower part)
32*b*, 106*a* outer circumferential surface
34, 108 piston rod
34*a*, 108*a* outer circumferential surface
36 hydraulic cylinder
42, 104*a* opening hole
44, 46 O-ring (leakage preventing means)
50 threaded portion
52 upper oil chamber (liquid chamber)
54 lower oil chamber (liquid chamber)
62 outer cylinder
110 space
112 seal member (leakage preventing means)
112*a* inner end
112*b* outer end
G1 second micro clearance
G2 first micro clearance (regulating means)

The invention claimed is:

1. Legged furniture having four or more legs and a load-receiving plate supported directly or indirectly by said legs, comprising:

three main legs among the legs defining a triangular shape, the three main legs enabling a stable stationary attitude of the load-receiving plate assuming that the legged furniture is placed by using only the main legs; and a leg adjuster forming an extension portion of a sub leg other than the main legs and capable of expansion and contraction in a vertical direction and providing an expansion and contraction leg in cooperation with the sub leg and autonomously allowing expansion or contraction of the expansion and contraction leg on the basis of a length of the main leg in accordance with the stationary attitude of the load-receiving plate, wherein the leg adjuster includes:

an adjuster body attached to a lower end of the sub leg and capable of vertical expansion and contraction;

urging means for urging the adjuster body in an expanding direction; and regulating means for regulating an expansion speed of the adjuster body having received an urging force of the urging means and a contraction speed of the adjuster body against the urging force;

the adjuster body in the form of a hydraulic cylinder, comprising an outer cylinder being a leg end of the expansion and contraction leg and having an opening hole and a bottom part, a piston accommodated in the outer cylinder, a piston rod protruding from the outer cylinder through the opening hole, and a threaded portion provided at a distal end of the piston rod and screwed into a lower end portion of the sub leg;

the urging means has a compression coil spring accommodated in the outer cylinder and extended between a lower part of the piston and the bottom part of the outer cylinder;

the regulating means has two liquid chambers partitioned by the piston in the outer cylinder and a first micro clearance ensured between an inner circumferential surface of the outer cylinder and an outer circumferential surface of the piston in order to regulate flowing of a liquid between these liquid chambers; and the leg adjuster has leakage preventing means for preventing leakage of the liquid from the opening hole.

2. The legged furniture according to claim 1, wherein the adjuster body has rotation preventing means for preventing rotation of the outer cylinder with respect to the piston or the piston rod.

3. The legged furniture according to claim 2, wherein the rotation preventing means prevents rotation of the outer cylinder with respect to the piston or the piston rod by forming a non-perfect circular shape when seen from a cross section on at least one of the outer circumferential surface of the piston or the piston rod and an inner circumferential surface of the outer cylinder.

4. The legged furniture according to claim 1, wherein a second micro clearance is ensured between the piston rod and the opening hole; and the leakage preventing means is made of a seal member forming a space on the second micro clearance side in the outer cylinder by partitioning the outer cylinder from the liquid chamber on the piston rod side.

5. The legged furniture according to claim 4, wherein the seal member is formed having an annular band shape of an inner end locked by the outer circumferential surface of the piston rod and an outer end locked by the outer cylinder and allows expansion and contraction between the inner end and the outer end.

6. The legged furniture according to claim 1, wherein the outer cylinder has:

a small-diameter portion in which each said liquid chambers are formed; and a large-diameter portion in which a space is formed.

7. The legged furniture according to claim 1, further comprising:

a dummy adjuster forming an extension portion of the main leg and presenting an appearance similar to the adjuster body, wherein a main-leg raising from a lower surface of a outer cylinder of the dummy adjuster to a lower end portion of the main leg is set between a minimum raising of the sub leg when the leg adjuster is in a most contracted state and a maximum raising of the sub leg when the leg adjuster is in a most expanded state.

8. The legged furniture according to claim 1, a gravity center line of the legged furniture passes in the triangular shape or in the vicinity of the triangular shape.

9. A leg adjuster used for legged furniture having four or more legs and a load-receiving plate supported directly or indirectly by these legs, wherein the legged furniture has three main legs among the legs defining a triangular shape and, assuming that the legged furniture is placed by using only the main legs, enabling a stable stationary attitude of the load-receiving plate; and a sub leg other than the main legs;

the leg adjuster is detachably attached to the sub leg in order to form an extension portion of the sub leg and is capable of expansion and contraction in a vertical direction and provides an expansion and contraction leg in cooperation with the sub leg and autonomously allows expansion or contraction of the expansion and contraction leg on the basis of a length of the main leg in accordance with the stationary attitude of the load-receiving plate; and the leg adjuster comprises:

an adjuster body in the form of a hydraulic cylinder, comprising an outer cylinder having an opening hole and a bottom part, a piston accommodated in the outer cylinder, a piston rod protruding from the outer cylinder through the opening hole, and a threaded portion provided at a distal end of the piston rod and screwed into a lower end portion of the sub leg;

urging means having a compression coil spring accommodated in the outer cylinder and extended between a lower part of the piston and the bottom part of the outer cylinder; and regulating means having two liquid chambers partitioned by the piston in the outer cylinder and a first micro clearance ensured between an inner circumferential surface of the outer cylinder and an outer circumferential surface of the piston in order to regulate flowing of a liquid between these liquid chambers; and leakage preventing means for preventing leakage of the liquid from the opening hole.

10. A leg adjuster set comprising:

combination of:

at least one unit of the aforementioned leg adjuster according to claim 9; and three dummy adjusters each of which is detachably attached to a main leg in order to form an extension portion of the main leg and presenting an appearance similar to the adjuster body and a main leg raising from a lower surface of a outer cylinder of the dummy adjuster to a lower end portion of the main leg is set between minimum raising of the sub leg when the leg adjuster is in a most contracted state and maximum raising of the sub leg when the leg adjuster is in a most expanded state.

* * * * *